United States Patent [19]

Fujita

[11] Patent Number: 4,849,333

[45] Date of Patent: Jul. 18, 1989

[54] METHOD FOR PROCESSING A SILVER HALIDE COLOR PHOTOGRAPHIC MATERIAL

[75] Inventor: Yoshihiro Fujita, Kanagawa, Japan

[73] Assignee: Fuji Photo Cilm Co., Ltd., Kanagawa, Japan

[21] Appl. No.: 185,263

[22] Filed: Apr. 18, 1988

Related U.S. Application Data

[63] Continuation of Ser. No. 863,907, May 16, 1986, abandoned.

[30] Foreign Application Priority Data

May 17, 1985 [JP] Japan ..... 60-105487

[51] Int. Cl.[4] ..... G03C 7/40; G03C 5/38; G03C 5/39; G03C 5/24

[52] U.S. Cl. ..... 430/372; 430/393; 430/428; 430/429; 430/463; 430/484; 430/490; 430/491

[58] Field of Search ..... 430/428, 429, 484, 463, 430/372, 490, 491, 393

[56] References Cited

U.S. PATENT DOCUMENTS

| | | | |
|---|---|---|---|
| 4,292,401 | 10/1979 | Itoh et al. | 430/393 |
| 4,414,305 | 11/1983 | Nakamura et al. | 430/489 X |
| 4,435,500 | 3/1984 | Okutsu et al. | 430/489 X |
| 4,469,780 | 9/1984 | Hirai et al. | 430/373 |
| 4,565,774 | 1/1986 | Kajiwara et al. | 430/489 X |

FOREIGN PATENT DOCUMENTS

| | | |
|---|---|---|
| 2323681 | 11/1974 | Fed. Rep. of Germany . |
| 3302741 | 8/1983 | Fed. Rep. of Germany . |

OTHER PUBLICATIONS

Patent Abstracts Japan vol. 10, No. 247, p. 490 Pub. Aug. 26, 1986.

*Primary Examiner*—Mukund J. Shah
*Attorney, Agent, or Firm*—Sughrue, Mion, Zinn, Macpeak & Seas

[57] ABSTRACT

A method is disclosed for the processing of an image-wise exposed silver halide color photographic material, wherein at least one of wash water and a stabilizing solution used in a step subsequent to a bleach-fixing step or a fixing step following a bleaching step contains at least one compound represented by formula (I)

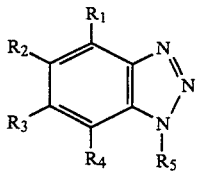

(I)

wherein $R_1$, $R_2$, $R_3$, $R_4$, and $R_5$ each represents a hydrogen atom, a halogen atom, an alkyl group, a substituted alkyl group, an acyl group, a hydroxy group, an amino group, a nitro group, a carboxy group, or a sulfo group.

20 Claims, No Drawings

METHOD FOR PROCESSING A SILVER HALIDE COLOR PHOTOGRAPHIC MATERIAL

This is a Continuation of application Ser. No. 06/863,907, filed May 16, 1986, now abandoned.

BACKGROUND OF THE INVENTION

The present invention relates to a method for processing silver halide color photographic materials, and more particularly to a method which allows for a significant reduction in the amount of water used in washing and stabilizing steps.

The conventional processing of silver halide photographic materials involves washing and stabilizing steps which require the use of a lot of water. For various reasons, such as the need to clean up the environment, limited water resources, and the increasing cost of water, many proposals for using less water in photographic processing have been put forward. S. R. Goldwasser, for instance, proposed in "Water Flow Rates in Immersion-Washing of Motion Picture Film", *Journal of the Society of Motion Picture and Television Engineers*, Vol. 64, pp. 248–253, May, 1955, a method for reducing the wash water by having the flow of water in adjacent wash tanks arranged to run counter to the direction of travel of the paper. This method has been acclaimed as being an effective method of saving water and has been adopted by many laboratories for incorporation in their automatic developers. However, it was later found that the wash water containing the ferric ion and thiosulfate carried over from the bleaching and fixing, respectively, is highly labile and that a significant reduction in the amount of wash water causes the additional problem of the formation of various precipitates and suspended solids resulting from the prolonged residence time of the wash water. The deposits and suspended solids formed in the wash water will adhere to the processed paper or may clog or soil the filters in the automatic developer, inducing one or more troubles in the machine.

In order to solve these problems, many methods have been proposed for preventing the formation of precipitates in wash water. For example, L.E. West proposed the addition of chelating agents or bactericides in Water Quality Criteria, *Photographic Science and Engineering*, Vol. 9, p. 6, 1965. Japanese Patent Application (OPI) Nos. 8542/82, 105145/83 and 157244/82 (the term "OPI" as used herein refers to a "published unexamined Japanese patent application".) disclose the addition of mold inhibitors, but, for various reasons (e.g., low solubilities of the inhibitors, their potential toxicity, poor ability to prevent suspended solids or sediment formation, and impaired image stability), no completely satisfactory results have been obtained. Methods for adding chelating agents are described in Japanese Patent Application (OPI) Nos. 8542/82, 58143/82, 132146/82, and 18631/83, but no satisfactory results have been attained, either, because the chelating agents employed are either insufficient in their effectiveness against the formation of suspended solids or precipitates, or likely to cause adverse effects on the keeping quality of the image. Sulfites may be used in combination with chelating agents as described in Japanese Patent Application (OPI) Nos. 97530/82, 88738/84, and 88739/84, but the effectiveness of this approach is also below the desired level.

Other problems associated with the incorporation of bactericides, antiseptics, and other compounds having similar effects within the wash water or stabilizing bath employed in the processing of photographic materials are that they are highly likely to cause the fading of dyes or the progressive staining of the image with time. The incidence of such problems is particularly high if bactericides or antiseptics are added to the last bath, since the additives will remain in the processed photographic material.

SUMMARY OF THE INVENTION

The primary object, therefore, of the present invention is to provide a method for processing a silver halide color photographic material with an appreciably reduced amount of water being used in the washing or stabilizing step without sacrificing the image stability, and while realizing enhanced stabilization of the wash water or stabilizing solution per se.

Assuming that bacteria and fungi are mainly responsible for the formation of precipitates and suspended solids in the wash water or stabilizing solution containing ferric ion or thiosulfate, the present inventors investigated a host of additives in terms of their antibacterial or fungal action, and have surprisingly discovered that the compounds of formula (I) have a selective ability to improve the stability of wash water and stabilising solution.

The present invention is based on the above discovery and provides a method for the processing of an imagewise exposed silver halide color photographic material, wherein at least one of wash water and a stabilizing solution used in a step subsequent to a bleach-fixing step or a fixing step following the bleaching step contains at least one compound represented by formula (I)

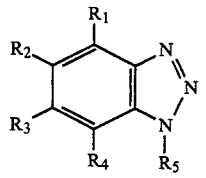

(I)

wherein $R_1$, $R_2$, $R_3$, $R_4$, and $R_5$ (which may be the same or different) each represents a hydrogen atom, a halogen atom (e.g., Cl or F), and alkyl group, a substituted alkyl group, an acyl group, a hydroxy group, an amino group, a nitro group, a carboxy group, or a sulfo group.

DETAILED DESCRIPTION OF THE INVENTION

The alkyl group preferably has from 1 to 10, and more preferably from 1 to 5, carbon atoms, and the total number of carbon atoms in the substituted alkyl group is preferably from 1 to 10 carbon atoms.

Preferred examples of the substituents represented by $R_1$, $R_2$, $R_3$, $R_4$ and $R_5$ include a hydrogen atom, a halogen atom, a straight chain or branched chain alkyl group having 1 to 4 carbon atoms, an acetyl group, an amino group, a nitro group, a hydroxy group, a carboxy group and a sulfo group. More preferred examples thereof include a halogen atom, a straight chain or branched chain alkyl group having 1 to 4 carbon atoms, an acetyl group and a hydroxy group.

Preferred examples of the compounds of the formula (I) include those in which $R_2$ and $R_3$ alone are a substituent selected from the above-described substituents represented by $R_1$ to $R_5$ excepting a hydrogen atom or those in which $R_5$ alone is a hydroxy group. The compound of the formula (I) in which $R_1$, $R_2$, $R_3$, $R_4$ and $R_5$ all represent a hydrogen atom is highly effective in stabilizing processing solutions and has an excellent solubility. The compounds of the formula (I) which contain one substituent from the above-described substituents represented by $R_1$ to $R_5$ excepting a carboxy group and a sulfo group have an excellent sterilizing effect per mole.

Specific examples of the compounds of formula (I) are listed below, but it should be understood that the scope of the present invention is by no means limited to these examples.

I-1

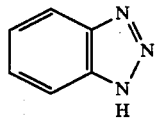

I-2

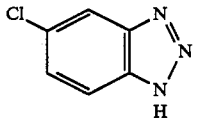

I-3

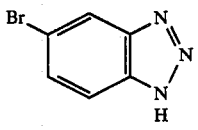

I-4

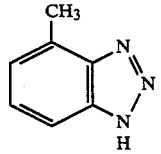

I-5

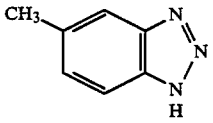

I-6

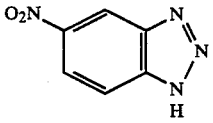

I-7

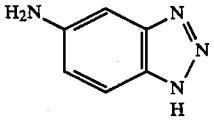

I-8

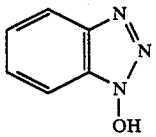

-continued

I-9

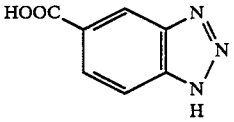

I-10

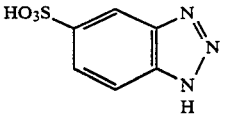

I-11

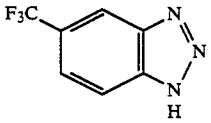

I-12

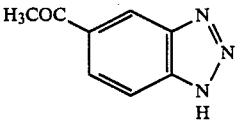

I-13

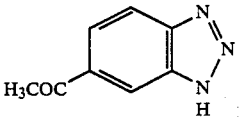

I-14

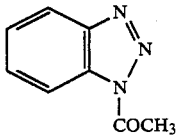

I-15

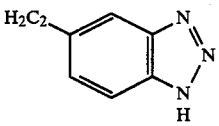

I-16

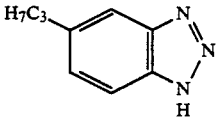

I-17

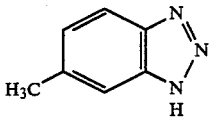

I-18

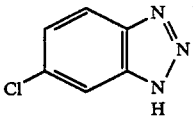

I-19

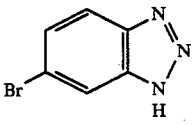

Compounds of formula (I) are known and commercially available, or may be synthesized by conventional methods as described in Damschroden and Petersen, *Org. Syn., Coll.* Vol. III, 106 (1955).

The compounds of formula (I) are added to wash water and/or stabilizing solution preferably in amounts ranging from $1\times10^{-5}$ to 1.0 mol per liter, and more preferably from $1\times10^{-4}$ to $2\times10^{-2}$ mol per liter.

The wash water and/or stabilizing solution employed in the method of the present invention contains a ferric salt (i.e., bleaching component) and a thiosulfate (i.e., fixing component) that is invariably carried over from the previous bath (i.e., bleach bath, fix bath or bleach-fix bath) as the photographic material is continuously processed. The content of the ferric salt or thiosulfate will vary with the specific method of washing or stabilization; the iron concentration ranges typically from $1\times10^{-6}$ to $1\times10^{-1}$ mol per liter, and more typically from $1\times10^{-5}$ to $5\times10^{-2}$ mol per liter, and the thiosulfate concentration ranges typically from $1\times10^{-4}$ to $5\times10^{-1}$ mol per liter, and more typically from $1\times10^{-3}$ to $3\times10^{-1}$ mol per liter.

The wash water or stabilizing solution used in the method of the present invention may also contain known bactericides or mold inhibitors in addition to the compounds of formula (I) or metallic compounds. Such optional additives may be selected, for example, from the following commonly used bactericides and mold inhibitors thiazolyl benzimidazole compounds as shown in Japanese Patent Application (OPI) Nos. 157244/82 and 105145/83; isothiazolone compounds as shown in Japanese Patent Application (OPI) No. 8542/82; chlorophenol compounds as typified by trichlorophenol; bromophenol compounds; organotin compounds; thiocyanic acid or isocyanic acid based compounds; sulfamide-based compounds such as sulfanylamide; acid amide compounds; diazine- or triazine-based compounds; thiourea compounds; alkylguanidine compounds; quaternary ammonium salts as typified by benzalkonium chloride; antibiotics as typified by penicillin; and activated halides such as sodium hypochlorite and sodium chloroisocyanutrate. The compounds described in H. Horiguchi, "Bokin-Bobaino Kagaku (Chemistry of Bacteria and Mold Inhibition)", Sankyo Shuppansha, 1982 may also be used. These compounds and those listed above may be used either individually or in combination. It is particularly preferable that the compounds of formula (I) are used in combination with sulfamide compounds, activated halogen compounds, thiazolyl benzimidazole compounds, or isothiazolone compounds.

The wash water may additionally contain a variety of compounds such as hardeners, such as magnesium or aluminum salts, surfactants intended for avoiding unevenness, brighteners for providing a higher degree of whiteness, sulfites serving as preservatives, bismuth salts which ensure accelerated chelating with iron, as well as aqueous ammonia or various ammonium salts capable of improving the keeping quality of the image formed on the processed photographic material. Other compounds which may be used are found in L.E. West, "Water Quality Criteria", *Phot. Sci. and Eng.*, Vol. 9, No. 6, 1965.

The use of surfactants is particularly preferable for attaining the purpose of rendering the wash water more stable. Anionic, cationic, nonionic or amphoteric surfactants may be used, but anionic, surfactants, especially those containing a sulfonic acid group, are preferable.

In addition to the compounds of formula (I), the wash water preferably contains a chelating agent selected from known chelators based on inorganic phosphoric acids, organic carboxylic acids, aminopolycarboxylic acids, phosphonocarboxylic acids, alkylphosphonic acids, or aminopolyphosphonic acids. Chelating agents which are particularly preferable for use in combination with the compounds of formula (I) include ethylenediaminetetraacetic acid, hydroxyethyl ethylenediaminetriacetic acid, 1,2-diaminopropane-N,N,N',N'-tetraacetic acid, 1-hydroxyethylidene-1,1-diphosphonic acid, nitrilo-N,N,N-trimethylenephosphonic acid, and ethylenediamine-N,N,N', N'-tetramethylenephosphonic acid. These chelating agents are added to the wash water in amounts which typically range from $1\times10^{-5}$ to $1\times10^{-1}$ mol per liter, and preferably from $1\times10^{-4}$ to $1\times10^{-2}$ mol per liter. If chelating agents are used, metal salts such as aluminum and nickel salts may also be used for the purpose of preventing precipitation of calcium ions.

With a view to reducing the amount of water necessary, the washing step in the method of the present invention is preferably carried out with a counter current multi-tank system, e.g., with 2 to 5 wash tanks which are arranged such that the flow of water in adjacent tanks runs counter to the direction of travel of the color photographic material. If this method is used, the amount of water required is reduced to a level between about 50 ml and 1,000 ml per square meter of the color photographic material. The amount of water necessary also varies with the number of wash tanks and the optimum value may be determined by reference to S.R. Goldwasser, "Water Flow Rates in Immersion-Washing of Motion Picture Film", *Journal of the Society of Motion Picture and Television Engineers*, Vol. 64, pp. 248–253, May 1955.

The wash water used in the method of the present invention typically has a pH of about 7, which may vary over the range of 3 to 9 depending upon chemical carry over from the previous bath. Washing is typically carried out at a temperature between 5° and 40° C., and preferably between 10° and 35° C. If desired, a heater, temperature controller, circulating pump, filters, floating lid, and a squeegee may be incorporated in the wash tanks.

The washing step may be followed by stabilization step. If desired, the washing step may be omitted and the photographic material may be stabilized immediately after fixing or bleach-fixing. Any working solutions capable of stabilizing dye images may be employed as stabilizing solutions in the stabilization step. Typical stabilizing solutions are those which are buffered to have a pH between 3 and 6, and those which contain an aldehyde, e.g., formalin (37 wt % formaldehyde solution). The stabilizing solution may optionally contain any of the aforementioned compounds which are used as additives in the wash water.

With a view to reducing the amount of water present in the stabilizing solution, the stabilization step is preferably carried out using a counter-current multi tank system, e.g., arranged such that the flow of the stabilizing solution in adjacent tanks runs counter to the direction of travel of the color photographic material. In this case, too, the amount of the required stabilizing solution is reduced to a level between about 50 ml and 1,000 ml per square meter of the color photographic material. The temperature of the stabilizing solution ranges typically from 5° to 40° C., and preferably from 10° to 35° C. If desired, a heater, temperature controller, circulating pump, filters, floating lid, and a squeegee may be incorporated in the stabilizing tanks.

The method of the present invention may be applied to the processing of any conventional silver halide color photographic materials such as color negative films, color papers, color positive films, and color reversal fims, and particularly good results are obtained when color papers and color negative films are processed by the present invention.

The method of the present invention can be run continuously. The term "continuously" as used herein means that the processing is continued or done with replenishing the component consumed during the processing of silver halide color photographic materials and removing unnecessary components, if desired. The method may be interrupted for several hours, e.g., by temporary troubles with the appliance used or for nights when service persons are unavailable. Interruption may last for about 8 hours or more as is usually done in the art.

The following are typical, but by no means limiting, schemes that may be adopted for carrying out photographic processing in accordance with the present invention:

A. color development - bleach-fixing - washing - drying;
B. color development - bleach-fixing - washing - stabilization - drying;
C. color development - washing - bleach-fixing - washing - drying;
D. color development - bleaching - fixing - washing - stabilization - drying;
E. color development - bleaching - fixing - washing - drying; and
F. color development - washing - bleaching - fixing - washing - drying.

The color developer used in the present invention contains a color developing agent. Preferable color developing agents are p-phenylenediamine derivatives and typical, but non-limiting examples thereof are listed below.

D-1: N,N-diethyl-p-phenylenediamine;
D-2: 2-amino-5-diethylaminotoluene;
D-3: 2-amino-5-(N-ethyl-N-laurylamino)toluene;
D-4: 4-[N-ethyl-N-(β-hydroxyethyl)amino]aniline;
D-5: 2-methyl-4-[N-ethyl-(β-hydroxyethyl-)amino]aniline;
D-6: N-ethyl-N-(β-methanesulfonamidoethyl)-3-methyl-4-aminoaniline;
D-7: N-(2-amino-5-diethylaminophenylethyl)methane-sulfonamide;
D-8: N,N-dimethyl-p-phenylenediamine;
D-9: 4-amino-3-methyl-N-ethyl-N-methoxyethylaniline;
D-10: 4-amino-3-methyl-N-ethyl-N-β-ethoxyethylaniline; and
D-11: 4-amino-3-methyl-N-ethyl-N-β-butoxyethylaniline.

These p-phenylenediamine derivatives may be in the form of salts with sulfuric acid, hydrochloric acid, sulfurous acid and p-toluenesulfonic acid. The compounds listed above are described in many patents, such as U.S. Pat. Nos. 2,193,015, 2,552,241, 2,566,271, 2,592,364, 3,656,950, and 3,698,525. The aromatic primary amino developing agents are used in the developer solution in amounts typically ranging from about 0.1 to about 20 g per liter, and preferably from about 0.5 to about 10 g per liter.

As is well known, the color developer used in the present invention may contain hydroxylamines. Although hydroxylamines could be used in the color developer in the form of free amines, they are more commonly employed in the form of their water-soluble salts, which are typified by sulfates, oxalates, chlorides, phosphates, carbonated, and acetates. Hydroxylamines may be substituted or unsubstituted, with the nitrogen atom in the hydroxylamine being optionally substituted by an alkyl group.

The color developer used in the present invention has a pH which ranges preferably from 9 to 12, and more preferably from 9 to 11. The color developer may also contain any of the compounds that are known to be usable as components of developing solutions. Such optional additives include alkali agents and pH buffers selected from among sodium hydroxide, potassium hydroxide, sodium carbonate, potassium carbonate, sodium tertiary phosphate, potassium tertiary phosphate, potassium metaborate and borax, which may be used either independently or in combination. Various salts may additionally be used for satisfying special needs, such as providing a buffering action, ensuring easy preparation or affording a higher ionic strength, and usable salts include disodium or dipotassium hydrogenphosphate, potassium or sodium dihydrogen phosphate, sodium or potassium bicarbonate, and alkali salts of boric acid, nitric acid, or sulfuric acid.

A variety of chelators may be incorporated in the color developer for the purpose of preventing calcium or magnesium precipitation, and suitable chelating agents include polyphosphates, aminopolycarboxylates, phosphonocarboxylates, aminopolyphosphonates, and 1-hydroxyalkylidene-1,1-diphosphonates.

The color developer may incorporate any known development accelerator depending on the need. Suitable development accelerators include a variety of pyrimidium compounds and other cationic compounds as described in U.S. Pat. No. 2,648,604, Japanese Patent Publication No. 9503/69 and U.S. Pat. No. 3,171,247; cationic dyes such as phenosafranine; neutral salts such as thallium nitrate and potassium nitrate; nonionic compounds such as polyethylene glycol, derivatives thereof and polythioethers (see Japanese Patent Publication No. 9304/69, U.S. Pat. Nos. 2,533,990, 2,531,832, 2,950,970, and 2,577,127; and thioether-based compounds as described in U.S. Pat. No. 3,201,242.

The color developer may also contain a compound which is commonly used as a preservative, such as sodium sulfite, potassium sulfite, potassium bisulfite, or sodium bisulfite.

The color developer used in the present invention may contain any anti-foggant as required. Usable anti-foggants include alkali metal halides such as potassium bromide, sodium bromide and potassium iodide, as well as organic anti-foggants. Illustrative organic anti-foggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine; mercapto-substituted heterocyclic compounds such as 1-phenyl-5-mercaptotetrazole, 2-mercaptobenzimidazole and 2-mercaptobenzothiazole; and mercapto-substituted aromatic compounds such as thiosalicylic acid. Nitrogen-containing heterocyclic compounds are particularly preferable. These anti-foggants may accumulate in the color developer as a result of dissolution from the color photographic material being processed, but no deleterious effect will arise from such accumulated anti-foggants.

An iron complex is incorporated as the bleaching component of the bleach bath or bleach-fix bath used in the method of the present invention. A preferable iron complex is an aminopolycarboxylic acid iron complex, which is used in an amount ranging typically from 0.01 to 1.0 mol per liter, and preferably from 0.05 to 0.50 mol per liter. A thiosulfate is incorporated as the fixing component of the fix bath or bleach-fix bath. A preferable thiosulfate is ammonium thiosulfate, which is used in an amount ranging typically from 0.1 to 5.0 mol per liter, and preferably from 0.5 to 2.0 mol per liter. Sulfites are commonly added as preservatives, but ascorbic acid, carbonylbisulfite adducts or carbonyl compounds may also be added. Other additives that may be incorporated in the fix bath as required include buffers, brighteners, chelators, and mold inhibitors.

A variety of compounds may be used as bleaching accelerators in the bleach bath, bleach-fix bath and/or baths that precede these baths. Illustrative bleach accelerators include those compounds having a mercapto or disulfide group which are described in U.S. Pat. No. 3,893,858, German Patent 1,290,812, Japanese Patent Application (OPI) No. 95630/78 and *Research Disclosure*, RD No. 17129, July 1978; thiazolidine derivatives as described in Japanese Patent Application (OPI) No. 140129/75; thiourea derivatives as described in U.S. Pat. No. 3,706,561; iodides as described in Japanese Patent Application (OPI) No. 16235/83; the polyethylene oxides as described in German Pat. No. 2,748,430; and polyamine compounds as described in Japanese Patent Publication No. 8836/70.

The following examples are provided for the purpose of further illustrating the present invention, but are by no means to be taken as limiting.

EXAMPLE 1

Rols of color negative films, HR-100 (24 exp.) of Fuji Photo Film, were subjected to imagewise exposure and were subsequently processed in a continuous fashion with a Fuji Color Negative Processor, FP-500 of Fuji Photo Film. The processing scheme was as follows.

| Steps | Time | Temperature | Tank Capacity | Replenishment (ml/roll) |
|---|---|---|---|---|
| Color development | 3' 15" | 38° C. ± 0.3° C. | 21 l | 45 |
| Bleaching | 4' 20" | 38° C. ± 3° C. | 18 l | 20 |
| Fixing | 3' 15" | 38° C. ± 3° C. | 18 l | 39 |
| Washing (1) | 1' 30" | 38° C. ± 3° C. | 8 l | — |
| Washing (2) | 2' 00 | 33° C. ± 3° C. | 8 l | 20 |
| Stabilization | 40" | 38° C. ± 3° C. | 13 l | 39 |

The wash water was caused to flow from wash tank (2) to (1) so that it was counter to the direction of travel of the negative film. The carryover into the working solution in each tank from the previous one was about 2 ml per roll.

The compositions of the tank solutions are shown below, together with the formulation of the respective replenishers.

| | Tank solution | Replenisher |
|---|---|---|
| Color developer: | | |
| Sodium nitrilotriacetate | 1.0 g | 1.1 g |
| Sodium sulfite | 4.0 g | 4.4 g |
| Sodium carbonate | 30.0 g | 32.0 g |
| Potassium bromide | 1.4 g | 0.7 g |
| Hydroxylamine sulfate | 2.4 g | 2.6 g |
| 4-(N—ethyl-N—hydroxyethyl-amino)-2-methylaniline sulfate | 4.5 g | 5.0 g |
| Water to make | 1 l | 1 l |
| pH | 10.00 | 10.05 |
| Bleaching solution: | | |
| Ammonium bromide | 160.0 | 176.0 g |
| Aqueous ammonia (28% sol.) | 25.0 | 15.0 g |
| Ethylenediaminetetraacetic acid sodium rion salt | 130.0 g | 143.0 g |
| Glacial acetic acid | 14.0 ml | 14.0 ml |
| Water to make | 1 l | 1 l |
| pH | 6.0 | 5.7 |
| Fixing solution: | | |
| Sodium tetrapolyphosphate | 2.0 g | 2.2 g |
| Sodium sulfite | 4.0 g | 4.4 g |
| Ammonium thiosulfate (70% sol.) | 175.0 ml | 193.0 ml |
| Sodium bisulfite | 4.6 g | 5.1 g |
| Water to make | 1 l | 1 l |
| pH | 6.6 | 6.6 |
| Stabilizing solution: | | |
| Formalin | 8.0 ml | 8.0 ml |
| Driwell(Polyoxyethylene-p-monononylphenyl ether (average number of addition: about 10), a product by Fuji Photo Film Co., Ltd.) | 0.3 g | 0.3 g |
| Water to make | 1 l | 1 l |

Under the conditions described above, the color negative film rolls were processed for 60 consecutive days on a 40-roll-a-day basis. The number of days required for suspended matter precipitates to form in wash tank (1) or (2) is indicated in Table 1. The results obtained with the samples containing selected compounds in the wash water (both in the tank solution and the replenisher) are also shown in Table 1. The circles in Table 1 indicate that no suspended matter or precipitate formed during the 60-day processing.

TABLE 1

| Sample No. | Washing conditions: Compound added | Amount (mol/1,000 ml) | pH of wash water* | Days: Tank (1) | Days: Tank (2) | Remarks |
|---|---|---|---|---|---|---|
| 1 | — | — | 7.0 | 14 | 7 | Comparative sample |
| 2 | Sodium dehydroacetate | $5 \times 10^{-4}$ | 7.0 | 20 | 11 | " |
| 3 | Potassium sorbate | $5 \times 10^{-4}$ | 7.0 | 17 | 10 | " |
| 4 | 2-(4-thiazolyl)-benzimidazole | $1 \times 10^{-4}$ | 7.0 | 23 | 11 | " |
| 5 | Ethylenediaminetetra-acetic acid | $5 \times 10^{-4}$ | 7.0 | 20 | 11 | " |

TABLE 1-continued

| Sample No. | Compound added | Washing conditions: Amount (mol/1,000 ml) | pH of wash water* | Days: Tank (1) | Tank (2) | Remarks |
|---|---|---|---|---|---|---|
| 6 | Ethylenediamine-N,N,N,N'—tetramethylene-phosphonic acid | $5 \times 10^{-4}$ | 7.0 | 20 | 11 | " |
| 7 | I-1 | $5 \times 10^{-4}$ | 7.0 | ○ | 50 | Sample of the invention |
| 8 | I-5 | $5 \times 10^{-4}$ | 7.0 | | 50 | Sample of the invention |
| 9 | Sodium dehydroacetate and ethylenediamine-tetraacetic acid | $5 \times 10^{-4}$ | 7.0 | 20 | 11 | Comparative sample |
| 10 | I-1 and ethylenediamine-tetraacetic acid | $5 \times 10^{-4}$ | 7.0 | ○ | ○ | Sample of the invention |
| 11 | I-1 and ethylenedia-mine-N,N,N',N—tetra-methylenephonsphonic acid | $5 \times 10^{-4}$ | 7.0 | ○ | ○ | Sample of the invention |
| 12 | I-5 and ethylenedia-minetetraacetic acid | $5 \times 10^{-4}$ | 7.0 | ○ | ○ | Sample of the invention |

(*adjusted with KOH and $H_2SO_4$)

In accordance with the present invention (Sample Nos. 7, 8, 10, 11 and 12), the stability of the wash water was appreciably improved whether it was used in washing step (1) or (2).

EXAMPLE 2

Color papers (Fuji Color Paper Type 01 of Fuji Photo Film Co., Ltd.) were exposed imagewise and subsequently processed by a continuous method in a Fuji Color Paper Processor, FMPP-100 (Fuji Photo Film), using the scheme indicated below.

| Steps | Time | Temperature | Tank capacity | Replenishment ($ml/m^2$) |
|---|---|---|---|---|
| Color development | 3' 30" | 38° C. ± 0.3° C. | 88 l | 161 |
| Bleach-fixing | 1' 30" | 33° C. ± 3° C. | 35 l | 60 |
| Washing (1) | 40" | 33° C. ± 3° C. | 17 l | — |
| Washing (2) | 40" | 33° C. ± 3° C. | 17 l | — |
| Washing (3) | 40" | 33° C. ± 3° C. | 17 l | 250 |

The wash water was caused to flow from wash tank (3) through (2) to (1) counter to the direction of travel of the color paper. The carryover into the working solution in each tank from the previous tank was about 60 ml per square meter of the color paper.

The compositions of the tank solutions are shown below, together with the formulations of the respective replenishers.

| | Tank solution | Replenisher |
|---|---|---|
| Color developer: | | |
| Water | 800 ml | 800 ml |
| Nitrilotriacetic acid trisodium salt | 2.0 g | 2.0 g |
| Benzyl alcohol | 14 ml | 14 ml |
| Diethylene glycol | 10 ml | 10 ml |
| Sodium sulfite | 2.0 g | 2.5 g |
| Hydroxylamine sulfate | 3.0 g | 3.5 g |
| Potassium bromide | 1.0 g | — |
| Sodium carbonate | 30 g | 35 g |
| N—ethyl-N—(β-methanesulfon-amidoethyl)-3-methyl-4-aminoaniline sulfate | 5.0 g | 8.0 g |
| Water to make | 1,000 ml | 1,000 ml |
| pH | 10.15 | 10.65 |
| Bleach-fixing solution: | | |
| Water | 400 ml | 400 ml |
| Ammonium thiosulfate (70% sol.) | 150 ml | 300 ml |
| Sodium sulfite | 18 g | 36 g |
| Ethylenediaminetetraacetic acid iron (III) ammonium salt | 55 g | 110 g |
| Ethylenediaminetetraacetic acid disodium salt | 5 g | 10 g |
| Water to make | 1,000 ml | 1,000 ml |
| pH | 6.70 | 6.50 |

Under the conditions described above, and color papers were processed for 60 consecutive days on a $10m^2$-per-day basis. The number of days required for suspended matter or precipitates to form in wash tank (1) or (2) or (3) is indicated in Table 2. The results obtained with the samples containing selected compounds in the wash water (both in the tank solution and the replenisher) are also shown in Table 2. The circles in Table 2 have the same meaning as defined for Table 1.

TABLE 2

| Sample No. | Compound added | Washing conditions: Amount (mol/1,000 ml) | pH of wash water* | Days: Tank (1) | Tank (2) | Tank (3) | Remarks |
|---|---|---|---|---|---|---|---|
| 13 | — | — | 7.0 | 16 | 10 | 5 | Comparative sample |
| 14 | Sodium dehydro-acetate | $5 \times 10^{-3}$ | 7.0 | 20 | 12 | 7 | Comparative sample |
| 15 | Potassium sorbate | $5 \times 10^{-3}$ | 7.0 | 16 | 10 | 6 | Comparative sample |
| 16 | 2-(4-thiazolyl)- | $1 \times 10^{-4}$ | 7.0 | 35 | 19 | 15 | Comparative |

TABLE 2-continued

| Sample No. | Washing conditions: Compound added | Amount (mol/1,000 ml) | pH of wash water* | Days: Tank (1) | Tank (2) | Tank (3) | Remarks |
|---|---|---|---|---|---|---|---|
| | benzimidazole | | | | | | sample |
| 17 | 1-hydroxyethylidene-1,1-disphosphonic acid | $5 \times 10^{-3}$ | 7.0 | 40 | 25 | 18 | Comparative sample |
| 18 | Ethylenediamine-N,N,N',N'—tetramethylenephosphonic acid | $5 \times 10^{-3}$ | 7.0 | 40 | 25 | 20 | Comparative sample |
| 19 | I-1 | $5 \times 10^{-3}$ | 7.0 | ○ | ○ | 55 | Sample of the invention |
| 20 | I-8 | $5 \times 10^{-3}$ | 7.0 | ○ | ○ | 50 | Sample of the invention |
| 21 | Sodium dehydroacetate and 1-hydroxyethylidene-1,1-disphosphonic acid | $5 \times 10^{-3}$ | 7.0 | 40 | 25 | 20 | Comparative sample |
| 22 | I-1 and 1-hydroxyethylidene-1,-1-disphosphonic acid | $5 \times 10^{-3}$ | 7.0 | ○ | ○ | ○ | Sample of the invention |
| 23 | I-1 and ethylenediaminie-N, N, N',-N'—tetramethylenephosphonic acid | $5 \times 10^{-3}$ | 7.0 | ○ | ○ | ○ | Sample of the invention |
| 24 | I-8 and 1-hydroxyethylidene-1,-1-diphosphonic acid | $5 \times 10^{-3}$ | 7.0 | ○ | ○ | ○ | Sample of the invention |

(*adjusted with KOH and $H_2SO_4$)

In accordance with the present invention (Sample Nos. 19, 20, 22, 23 and 24), the stability of the wash water in tanks (1) to (3) was appreciably improved. The stability was further improved by using the compounds of formula (I) in combination with chelating agents as in Sample Nos. 22 to 24, and at no stage of the processing that continued for 60 days did the formation of precipitate or suspended matter occur, even in the inherently labile wash water in tank (3). The images formed on the samples processed in accordance with the present invention also exhibited high stability.

EXAMPLE 3

Fuji Color Paper Type 01 of Fuji Photo Film Co., Ltd. were imagewise exposed and subsequently processed by a continuous method in the same manner as in Example 2 except that in place of washing steps (1), (2) and (3) were carried out stabilizing steps (1), (2) and (3) using a stabilizing solution having the formulation set forth below in a similar counter-current flow and that the color papers were processed at a rate of on a 40 $m^2$-per-day basis in stead of 10 $m^2$-per-day basis.

| Stabilizing Solution | Tank Solution | Replenisher |
|---|---|---|
| Acetic Acid | 0.6 g | 0.6 g |
| Sodium Acetate | 1.7 g | 1.7 g |
| Ammonium Chloride | 2.0 g | 2.0 g |
| Water to make | 1 l | 1 l |
| pH | 5.5 | 5.5 |

Under the conditions described above, the color negative film rolls were processed for 15 consecutive days. Each of the stabilizing solutions (1), (2) and (3) was poured in 12 beakers each in an amount of ml, and compounds shown in Table 3 were added thereto and pH of the mixtures was adjusted. The thus obtained sample solutions were allowed to stand at 25° C. for 15 days. The number of days required for suspended matter precipitates to form in the stabilizing solutions was examined. The results obtained are shown in Table 3. The circles in Table 3 indicate that no suspended matter or precipitate formed during the 15-day processing.

TABLE 3

| Sample No. | Stabilizer conditions: Compound added | Amount (mol/1,000 ml) | pH of stabilizer* | Days: Tank (1) | Tank (2) | Tank (3) | Remarks |
|---|---|---|---|---|---|---|---|
| 25 | — | — | 5.5 | 12 | 3 | 2 | Comparative sample |
| 26 | Sodium dehydroacetate | $5 \times 10^{-3}$ | 5.5 | 13 | 3 | 3 | Comparative sample |
| 27 | Potassium sorbate | $5 \times 10^{-3}$ | 5.5 | 13 | 3 | 3 | Comparative sample |
| 28 | 2-(4-thiazolyl)-benzimidazole | $1 \times 10^{-4}$ | 5.5 | 13 | 4 | 4 | Comparative sample |
| 29 | 1-hydroxyethylidene-1,1-diphosphonic acid | $5 \times 10^{-3}$ | 5.5 | 12 | 4 | 4 | Comparative sample |

TABLE 3-continued

| Sample No. | Stabilizer conditions: Compound added | Amount (mol/1,000 ml) | pH of stabilizer* | Days: Tank (1) | Tank (2) | Tank (3) | Remarks |
|---|---|---|---|---|---|---|---|
| 30 | Ethylenediamine-N,N,N',N'—tetramethylenephosphonic acid | $5 \times 10^{-3}$ | 5.5 | 13 | 5 | 3 | Comparative sample |
| 31 | I-1 | $5 \times 10^{-3}$ | 5.5 | ○ | ○ | 12 | Sample of the invention |
| 32 | I-8 | $5 \times 10^{-3}$ | 5.5 | ○ | ○ | 10 | Sample of the invention |
| 33 | Sodium dehydroacetate and 1-hydroxyethylidene-1,1-diphosphonic acid | $5 \times 10^{-3}$ | 5.5 | 13 | 4 | 4 | Comparative sample |
| 34 | I-1 and 1-hydroxyethylidene-1,-1-diphosphonic acid | $5 \times 10^{-3}$ | 5.5 | ○ | ○ | ○ | Sample of the invention |
| 35 | I-1 and ethylenediamine-N,N,N',-N'—tetramethylenephosphonic acid | $5 \times 10^{-3}$ | 5.5 | ○ | ○ | ○ | Sample of the invention |
| 36 | I-8 and 1-hydroxyethylidene-1,-1-disphosphonic acid | $5 \times 10^{-3}$ | 5.5 | ○ | ○ | ○ | Sample of the invention |

(*adjusted with NaOH and $Ch_3COOH$)

From the results shown in Table 3, it can be seen that when a stabilizing step was used in place of a washing step similar results were obtained and no problem was observed with respect to image stability after processing.

By using the compounds of formula (I) in accordance with the present invention, silver halide color photographic materials can be processed with an appreciably reduced amount of water being used in the washing or stabilizing step without sacrificing image stability (i.e., with minimum fading of dyes and minimum staining of the image), while simultaneously realizing enhanced stabilization of the wash water or stabilizing solution per se.

An addition advantage of using the compounds (I) is that they can be incorporated in the last bath in order to improve the working solution in it without impairing the keeping quality of the image.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color photographic material, wherein at least one of wash water and a stabilizing solution used in a step subsequent to a bleach-fixing step or a fixing step following a bleaching step contains at least one compound represented by formula (I)

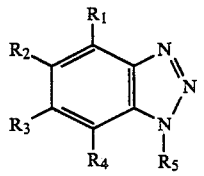

(I)

wherein $R_1$, $R_2$, $R_3$, $R_4$, and $R_5$ each represents a hydrogen atom, a halogen atom, an alkyl group, a substituted alkyl group, an acyl group, a hydroxy group, an amino group, a nitro group, a carboxy group, or a sulfo group, wherein the compounds of formula (I) are added to the wash water, the stabilizing solution or the wash water and the stabilizing solution in an amount of from $1 \times 10^{-4}$ to $2 \times 10^{-2}$ mol per liter, whereby said at least one compound represented by formula (I) is present in an anti-bacterial or anti-fungal amount.

2. A method as in claim 1, wherein said compound is a compound in which $R_1$, $R_2$, $R_3$, $R_4$, and $R_5$ each represents a hydrogen atom.

3. A method as in claim 1, wherein the compound of formula (I) is contained in wash water, and said wash water contains a chelating agent.

4. A method as in claim 1, wherein said chelating agent is selected from the group consisting of ethylenediaminetetraacetic acid, hydroxyethyl ethylenediaminetriacetic acid, 1,2-diaminopropane-N,N,N',N'-tetraacetic acid, 1-hydroxyethylidene-1,1-diphosphonic acid, and ethylenediamine-N,N,N',N'-tetramethylene-phosphonic acid.

5. A method as in claim 1, wherein said washing step is carried out with a counter current multi-tank system.

6. A method as in claim 1, wherein said wash water and/or stabilizing solution further contains ferric salt or thiosulfate.

7. A method as in claim 6, wherein said wash water and/or stabilizing solution further contains a ferric salt in an amount of $1 \times 10^{-6}$ to $1 \times 10^{-1}$ mol per liter.

8. A method as in claim 6, wherein said wash water and/or stabilizing solution contains a ferric salt in an amount of $1 \times 10^{-5}$ to $5 \times 10^{-2}$ mol per liter.

9. A method as in claim 6, wherein said wash water and/or stabilizing solution further contains a thiosulfate in an amount of $1 \times 10^{-4}$ to $5 \times 10^{-1}$ mol per liter.

10. A method as in claim 6, wherein said wash water and/or stabilizing solution further contains a thiosulfate in an amount $1 \times 10^{-3}$ to $3 \times 10^{-1}$ mol per liter.

11. A method as in claim 1, wherein said method is carried out continuously.

12. A method as in claim 1, wherein processing solutions prior to the use of said wash water or said stabilizing solution are free of said compound, and said compound is added to said wash water and/or said stabilizing solution.

13. A method as in claim 1, wherein the alkyl group has from 1 to 10 carbon atoms.

14. A method as in claim 1, wherein the alkyl group has from 1 to 5 carbon atoms.

15. A method as in claim 1, wherein the total number of carbon atoms in the substituted alkyl group is from 1 to 10 carbon atoms.

16. A method as in claim 1, wherein the substituents on the alkyl group are selected from the group consisting of a halogen atom, a hydroxyl group, an amino group, a sulfo group, a nitro group, and a carboxy group.

17. A method as in claim 1, wherein said compound is a compound in which $R_1$, $R_2$, $R_3$, $R_4$ and $R_5$ each represents a hydrogen atom, a halogen atom, a straight chain or branched chain alkyl group having 1 to 4 carbon atoms, an acetyl group, an amino group, a nitro group, a hydroxy group, a carboxy group or a sulfo group.

18. A method as in claim 1, wherein said compound is a compound in which $R_1$, $R_2$, $R_3$, $R_4$ and $R_5$ each represents a halogen atom, a straight chain or branched chain alkyl group having 1 to 4 carbon atoms, an acetyl group or a hydroxy group.

19. A method as in claim 1, wherein said compound is a compound in which $R_2$ and $R_3$ each represents a halogen atom, a straight chain or branched chain alkyl group having 1 to 4 carbon atoms, an acetyl group, an amino group, a nitro group, a hydroxy group, a carboxy group or a sulfo group, and $R_1$, $R_4$ and $R_5$ have the same meanings as defined above, or $R_5$ represents a hydroxy group and $R_1$, $R_2$, $R_3$, and $R_4$ have the same meanings as defined above.

20. A method as in claim 1, wherein said compound is a compound in which one of $R_1$, $R_2$, $R_3$, $R_4$ and $R_5$ represents a hydrogen atom, a halogen atom, a straight chain or branched chain alkyl group having 1 to 4 carbon atoms, an acetyl group, an amino group, a nitro group or hydroxy group, and the rest each represents a hydrogen atom.

* * * * *